United States Patent [19]

Riegel

[11] Patent Number: 4,825,484

[45] Date of Patent: May 2, 1989

[54] CRIB WITH SAFETY TOP

[76] Inventor: Claudette C. Riegel, 2048 W. Atmore Cir., Deltona, Fla. 32725

[21] Appl. No.: 67,690

[22] Filed: Sep. 28, 1987

[51] Int. Cl.[4] ..... A47D 7/00

[52] U.S. Cl. ..... 5/97; 5/100; 135/96; 135/102

[58] Field of Search ..... 5/97, 93 R, 100, 414, 5/416; 135/102, 103, 96

[56] References Cited

U.S. PATENT DOCUMENTS

| | | | |
|---|---|---|---|
| 692,501 | 2/1902 | Bentley | 5/416 |
| 1,143,774 | 6/1915 | Nicholls | 5/416 |
| 1,169,521 | 1/1916 | Taylor | 5/97 |
| 1,594,256 | 7/1926 | Greene | 5/97 |
| 2,530,728 | 11/1950 | Ream | 5/97 |
| 2,681,659 | 6/1954 | Hrinsin | 5/93 R |
| 3,071,782 | 1/1963 | Ball | 5/414 |

FOREIGN PATENT DOCUMENTS

| | | | |
|---|---|---|---|
| 11321 | of 1929 | Australia | 5/97 |

*Primary Examiner*—Alexander Grosz

[57] ABSTRACT

A cover which forms a semi-circular canopy over the top of children's crib in order to prevent accidental injuries caused by children falling out of cribs. The cover is supported by rods spaced apart in intervals with said rods attached at each end of the headboard or footboard of the crib in such a manner to allow the rotation of the rods. The cover is opened easily by pushing it back over the crib from either side, thereby giving access to approximately two-thirds of the crib so the child can be removed or placed in the crib quickly and easily. Straps are also provided which fasten to the siderails of the crib to keep the cover closed and the siderails from dropping while the child is in the crib.

2 Claims, 3 Drawing Sheets

CRIB WITH SAFETY TOP

BACKGROUND OF THE INVENTION

This invention relates to children's cribs, and more particularly to safety devices which attach to children's cribs.

Injuries as a result of children falling from open cribs are quite common, thereby necessitating a safety device to prevent such accidents. Some prior patented inventions have attempted to solve this problem. For instance, U.S. Pat. No. 1,418,541 by Demlinger shows an entire crib with hinge-like doors which fold over the top of the crib in an A-shaped fashion to form a cage-like enclosure. U.S. Pat. No. 2,783,481 by Moriarty discloses a safety attachment consisting of inwardly curved bars around the crib top with an opening in the middle. U.S. Pat. No. 4,015,297 by Christian shows a shallow box-like structure which fits over the crib and attaches by loops to hooks at the corners of the crib.

Although the aforementioned patented devices may help prevent babies from falling out of the sides of the crib, a major disadvantage with such devices is that they must be removed or opened entirely when putting a child into or removing a child from a crib or when adjusting a crib's siderails because such devices are permanently attached to the siderails of the crib. On the other hand, the instant invention enables a child to be removed and placed in the crib easily and quickly and does not interfere with the adjustment of the crib siderails because it is removably attached to the siderails of the crib.

SUMMARY OF THE INVENTION

The primary object of this invention is to provide a crib safety attachment to help prevent accidental injuries caused by toddlers falling out of cribs often causing internal injuries, broken bones and other injuries.

Another object of this invention is to provide a such a crib safety attachment which allows a toddler to be placed in and removed easily from a crib without having to detach the entire device. This feature is especially important in emergencies.

An even further object of this invention is to provide a crib safety attachment which does not interfere with the operation of the crib, specifically the upward and downward adjustment of the crib's siderails.

An additional object of this invention is to provide such a cover which is adjustable in size so it can fit most standard cribs.

The instant invention accomplishes the above and other objects by providing a cover made of flexible material such as netting, webbing or mesh which is supported over a crib, like a canopy or awning, by rods spaced at lengthwise reinforced intervals of the cover. The ends of the siderails are flat so that the rods may be attached to the head and footboards by screws so the rods are rotatable around the screws to enable the cover to be folded up over the crib in a semi-circular-like fashion for opening. The cover is adjustable in length by rods which are made from a series of rods which can be connected end to end to vary the length thereof. To keep the top closed over the crib, straps are provided which attach to the reinforced area on the cover and are connected around the siderails of the crib. Thus, when the invention is properly installed the top is nearly foolproof since it cannot be opened nor the siderails dropped by a child inside. Also, the cover is designed to be opened widely, easily and quickly to give access to approximately two-thirds of the crib top, thereby allowing plenty of room to remove a child in the case of an emergency.

The other objects, advantages and features of this invention will become readily apparent from the following detailed description of the specific embodiments thereof when read in conjunction with the accompanying drawings.

BRIEF DESCRIPTION OF THE DRAWINGS

The drawings appended hereto are as follows.

DETAILED DESCRIPTION OF THE PREFERRED EMBODIMENT

Figure 1:
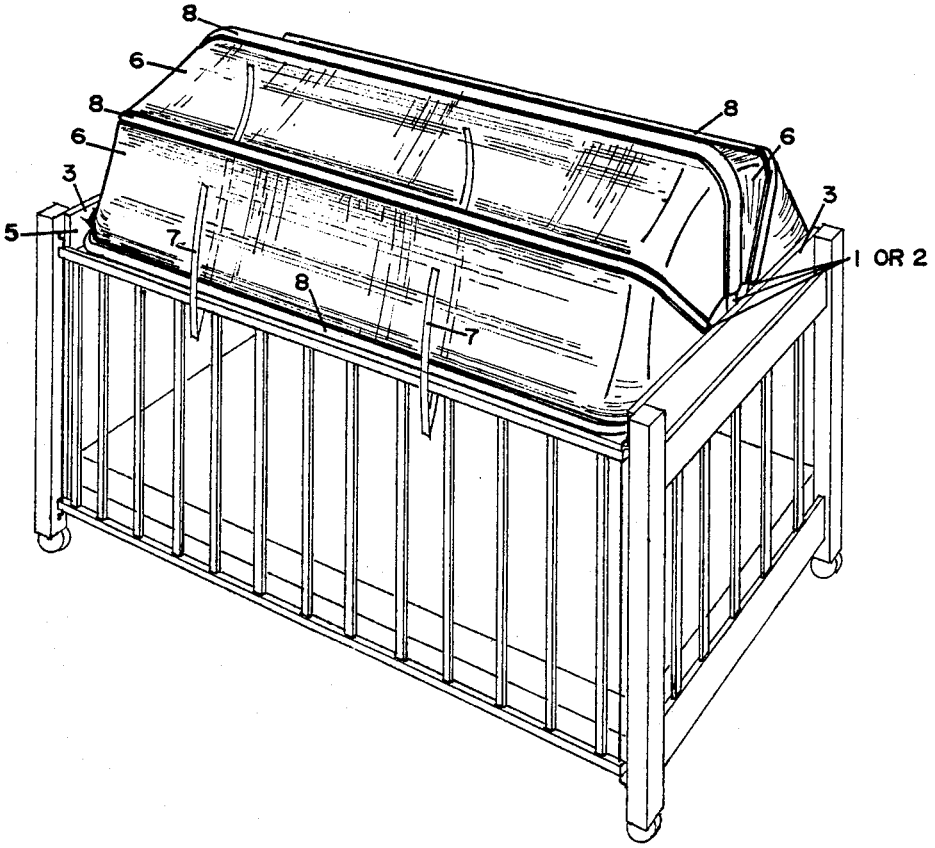
FIG. 1 is a perspective view showing the crib safety top as it would appear when attached to a crib.
Figure 2:
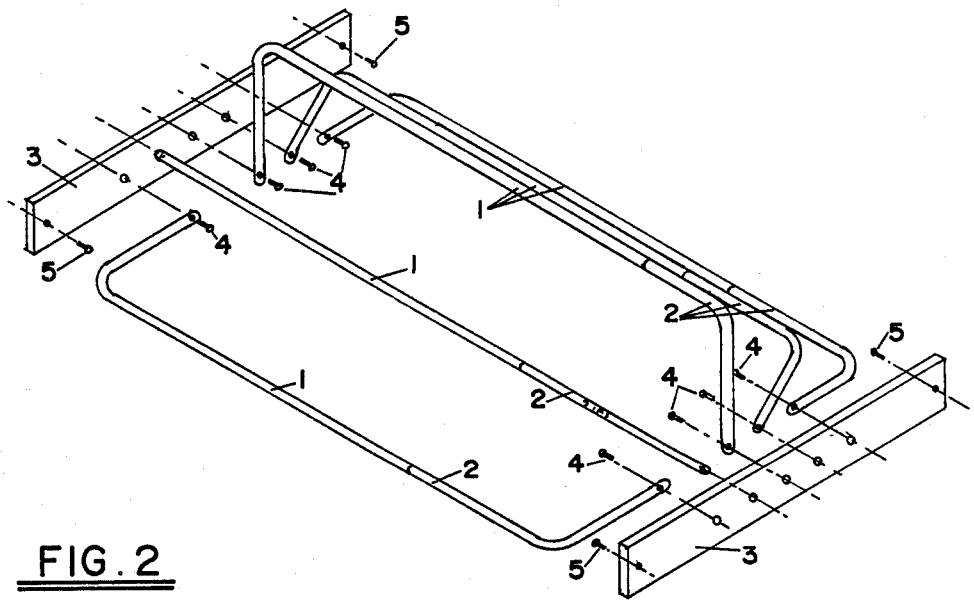
FIG. 2 is a perspective view showing the assembly of the framework supporting the cover.
Figure 3:
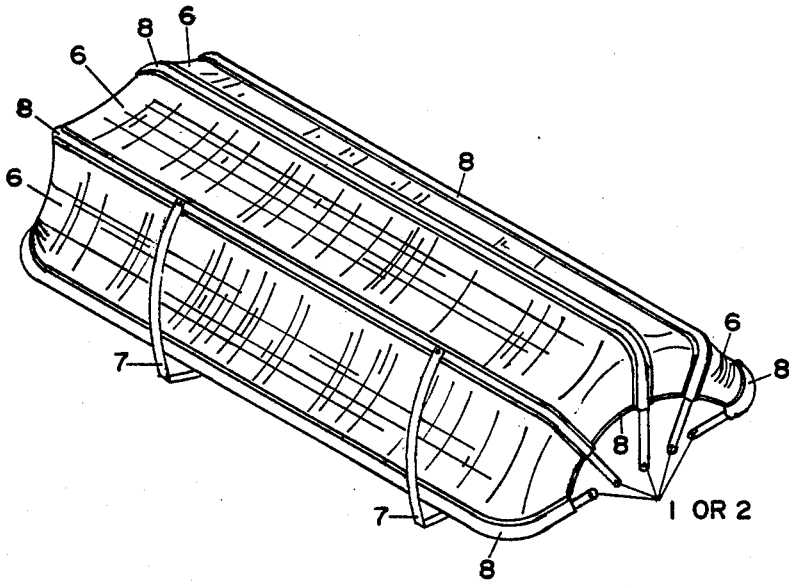
FIG. 3 is a perspective view of the cover by itself.

Referring now in detail to the drawings, FIG. 1 shows the crib safety cover which is the subject of this invention in a fully closed position on the top of a children's crib. As shown, the invention is comprised of a cover 6 made of flexible material, such as cloth netting, web or mesh, which may be made in panels or in one piece. The rods 1 and 2 are spaced at reinforced intervals 8 running lengthwise from the headboard to the footboard of the crib. The reinforcement intervals 8 may be plastic or other material stitched or glued to the cloth 6 so that the rods 1 and 2 can be slipped in and out of the reinforced intervals 8 in the cloth for assembly or disassembly.

Figure 5:
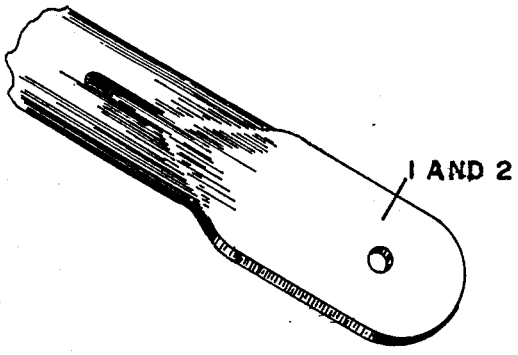
FIG. 5 is a cut-away perspective drawing showing the rotating portion of the rods.

The ends of the rods 1 and 2 are best illustrated in FIG. 5. The rods contain a hole on the ends for attachment to pivot boards shown as 3 in FIG. 1. In the preferred embodiment these rods are attached by shoulder screws 4 which have pan, truss or round heads to pivot boards 3 which are, in turn, mounted to the crib legs on the sides of the head or footboards by round, pan or truss headed machine screw with a hex cap nut or wood screw. Being attached in this manner, the ends of the rods are allowed to rotate when the cover 6 is opened. The pivot board 3 may be made of wood, plastic, metal or almost any material provided it is long enough to reach from one side of the head or footboard to the other.

Figure 4:
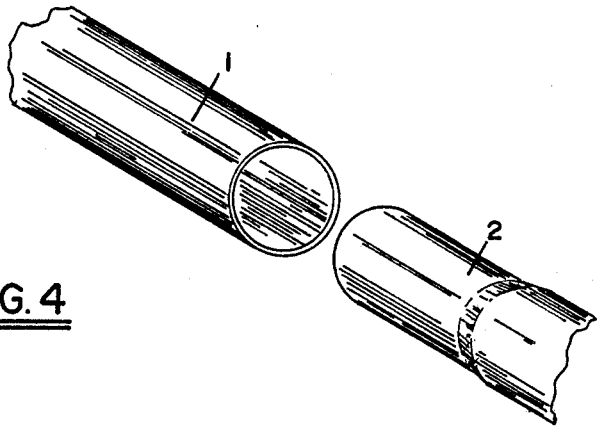
FIG. 4 is a cut-away perspective view of the connecting portion of the rods.

The assembly of the supporting framework of the cover details is best illustrated in FIG. 4. The rods I and 2 are made up of pieces of different lengths, rod 1 being longer than rod 2. The end of rod 2 is also compressed in diameter so that it fits inside the end of rod 1, thereby enabling an individual to adjust the length of invention to fit the length of the crib. The rods 1 and 2 may be made of tubular ferrous or non-ferrous material, plastic or almost any rigid material.

When the top is closed as shown in FIG. 1, four straps 7, two on each side of the cover 6, are attached to the reinforced intervals 8 on the first and second rods on each side of the cover 6. These straps 7 are fastened around the siderails of the crib by fastening material such as a hook and loop type fastener such as the one sold under the trademark of VELCRO, buttons or snaps. Thus, when properly mounted and fastened as shown in FIG. 1, neither the top can be opened by a child nor the siderails inadvertently dropped so as to provide complete safety from a child falling from the crib.

The operation of the invention is simple and easy. To open the top, one merely unfastens the straps 7 from either siderail of the crib and pushes the top up and over the crib similar to opening a roll-top desk. When the cover 6 is opened, the rods 1 and 2 rotate at the ends to allow the cover 6 to fold so that it collapses and rests on the opposite siderail. Closing the top is accomplished in the opposite manner by moving the cover back up and over the crib and fastening it by the straps 7 to the siderails of the crib.

As described in detail above, it should be apparent that there has been provided a new, useful and nonobvious invention having many advantages over inventions in the prior art. The crib safety top described herein is simple and adjustable in length to fit almost any standard-size crib. Moreover, the cover does not interfere with the adjustment of siderails of the crib since it is not permanently attached as are prior crib covers. Furthermore, the cover opens sufficiently wide to expose the child and, therefore, it does not have to be completely removed when putting sheets on the crib mattress or in the event of emergencies.

While one specific embodiment of the invention has been described in detail hereinabove, it is to be understood that various modifications may be made from the specific details described herein without departing from the spirit and scope of the invention as set forth in the appended claims.

Having described in detail my invention, I claim the following:

1. In combination with a crib having two spaced apart leg posts at its head end, and two spaced apart leg posts as its foot end, a first pivot board attached between the leg posts at the head end of the crib and a second pivot board attached between the leg posts at the foot end of the crib, a safety top to fit on top of the crib comprised of a cover made of flexible material supported by rods spaced at reinforced intervals running lengthwise along the cover, said rods being flat at each end and rotatably attached at each end by screws to the pivot boards at the head end and foot end of the crib.

2. The combination of claim 1 further comprising means for securing the cover in the closed position over the top of the crib consisting of straps attached to the cover and fastenable to the siderails of the crib.

* * * * *